US007198580B2

(12) United States Patent
Elder et al.

(10) Patent No.: US 7,198,580 B2
(45) **Date of Patent: *Apr. 3, 2007**

(54) PLAYING FIELD OBSTACLE DEVICE

(75) Inventors: James C. Elder, Carrollton, TX (US); Peter-Matias T. Lopez, Garland, TX (US)

(73) Assignee: The Soccer Wall Company, Carrollton, TX (US)

( * ) Notice: Subject to any disclaimer, the term of this patent is extended or adjusted under 35 U.S.C. 154(b) by 2 days.

This patent is subject to a terminal disclaimer.

(21) Appl. No.: 11/079,593

(22) Filed: Mar. 14, 2005

(65) Prior Publication Data

US 2005/0159250 A1 Jul. 21, 2005

Related U.S. Application Data

(63) Continuation-in-part of application No. 10/744,251, filed on Dec. 22, 2003, now Pat. No. 6,866,595.

(51) Int. Cl.
*A63B 69/00* (2006.01)

(52) U.S. Cl. ..... 473/446; 473/444

(58) Field of Classification Search ..... 473/446, 473/440–444, 438, 422; 273/401, 402; 43/2, 43/3; D21/125; 482/85
See application file for complete search history.

(56) References Cited

U.S. PATENT DOCUMENTS 1,007,628 A * 10/1911 Armstrong ..... 482/85
2,748,256 A * 5/1956 Moran ..... 362/362
4,815,784 A 3/1989 Zheng
4,837,958 A * 6/1989 Radovich ..... 40/538
4,869,503 A 9/1989 Grasso
4,934,938 A * 6/1990 Orlandi et al. ..... 473/444
5,116,273 A 5/1992 Chan
5,397,130 A 3/1995 Brown
5,527,185 A 6/1996 Davis
5,928,093 A 7/1999 Lai
6,012,994 A 1/2000 Beluse (Continued)

OTHER PUBLICATIONS

Web page from www.soccer.com, Kwik Goal Free Kick Man #16211, p. 1, May 14, 2003.

(Continued)

*Primary Examiner*—Eugene Kim
*Assistant Examiner*—M. Chambers
(74) *Attorney, Agent, or Firm*—Grady K. Bergen; Griggs Bergen LLP

(57) ABSTRACT

An obstacle device for use on a playing field has a base and a frame approximating in shape the front profile of a human head and torso. The frame is coupled to the base. The frame includes a collapsible frame member that has an expanded configuration that defines an expanded frame area. The frame member also has a collapsed configuration that defines a collapsed frame area that is less than the expanded frame area. A covering material is attached to the frame so that the covering material is spread by the frame when the frame member is in the expanded configuration.

19 Claims, 7 Drawing Sheets

U.S. PATENT DOCUMENTS

| | | | | |
|---|---|---|---|---|
| 6,266,904 | B1 | 7/2001 | Zheng | |
| 6,347,470 | B1 * | 2/2002 | Radovich | 40/610 |
| 6,374,530 | B1 * | 4/2002 | Mierau | 43/3 |
| 6,644,843 | B2 * | 11/2003 | Chin-Cheng | 362/97 |
| 6,866,595 | B1 * | 3/2005 | Elder et al. | 473/446 |
| 2003/0029074 | A1 * | 2/2003 | Volz | 43/2 |

OTHER PUBLICATIONS

Web page from www.soccer.com, Goal Sporting Goods Goal Wall #512, p. 1, May 14, 2003.

Web page from www.soccerrom.com, SorerROM's SoccerMall: Field Equipment, Performance Line Carry Bag, p. 1, May 17, 2003.

Photos of obstacle devices, no date listed.

* cited by examiner

FIG. 1
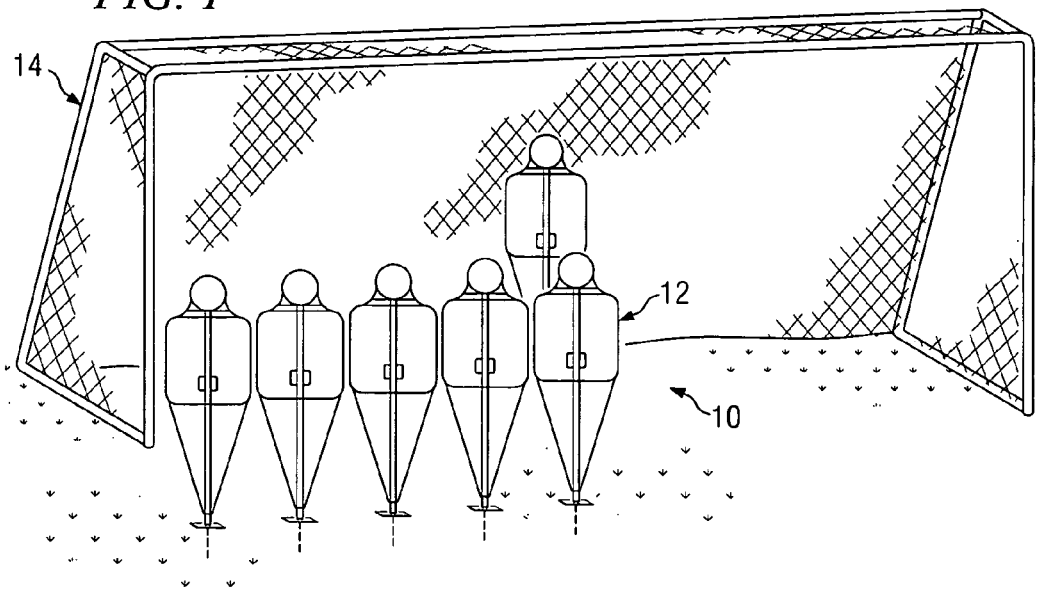
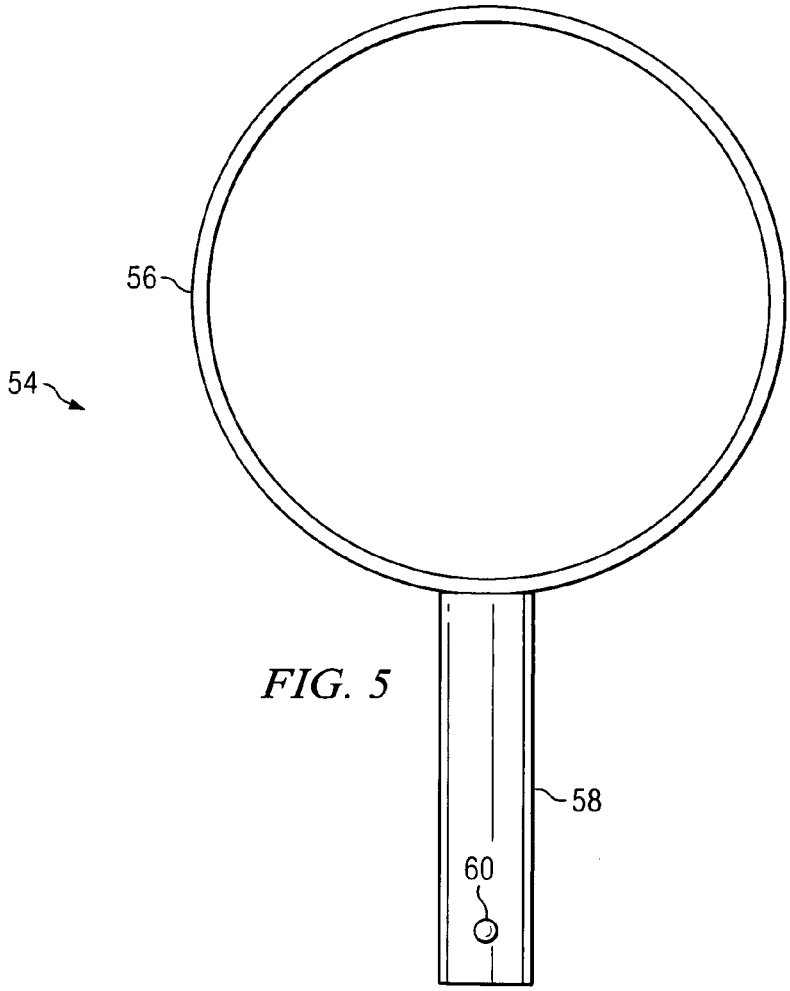
FIG. 5

PLAYING FIELD OBSTACLE DEVICE

This application is a continuation-in-part of U.S. patent application Ser. No. 10/744,251, filed Dec. 22, 2003, now U.S. Pat. No. 6,866,595, which is herein incorporated by reference in its entirety.

TECHNICAL FIELD

The invention relates generally to practice devices for sports and other activities.

BACKGROUND

In soccer, when certain fouls are committed against the offensive team, a "free kick" may be awarded. In such instances, the ball is positioned at a distance from the goal and an offensive player is allowed a "free kick" to attempt to kick the ball into the goal. Players of the defending team are allowed to stand at a distance from the kicker to form a blocking wall or obstacle between the kicker and the goal, making it more difficult for the kicker to score a goal.

During practice of such free kicks, one or more non-kicking players may be used to form the blocking wall. This, however, prevents the non-kicking players from participating in more beneficial practice exercises.

Blocking walls of various designs have been used in the past. These devices are non-collapsible and may be quite heavy, making them unwieldy and difficult to transport and store.

BRIEF DESCRIPTION OF THE DRAWINGS

For a more complete understanding of the present invention, reference is now made to the following descriptions taken in conjunction with the accompanying figures, in which:

FIG. 1 is a perspective view of a playing field employing a plurality of obstacle devices constructed in accordance with an embodiment of the invention;

FIG. 5 is a front elevational view of a head piece of the device of FIG. 2;

DETAILED DESCRIPTION

Referring to FIG. 1, a blocking wall 10 formed from obstacle devices 12 is positioned in front of a soccer goal 14 located on a playing field to serve as an obstacle during practice kicks. The wall 10 may be formed by positioning the obstacle devices 12 in a side-by-side relationship, as shown. Other configurations could be used, as well, such as a spaced apart or staggered configuration for use as a dribble course wherein a player moves between the devices. Although the wall 10 and obstacle devices 12 are shown being used in practice for soccer, it should be apparent to those skilled in the art the devices 12 may be useful and have application to other sports and activities, as well, and should not be limited to any particular use or activity.

Figure 2:
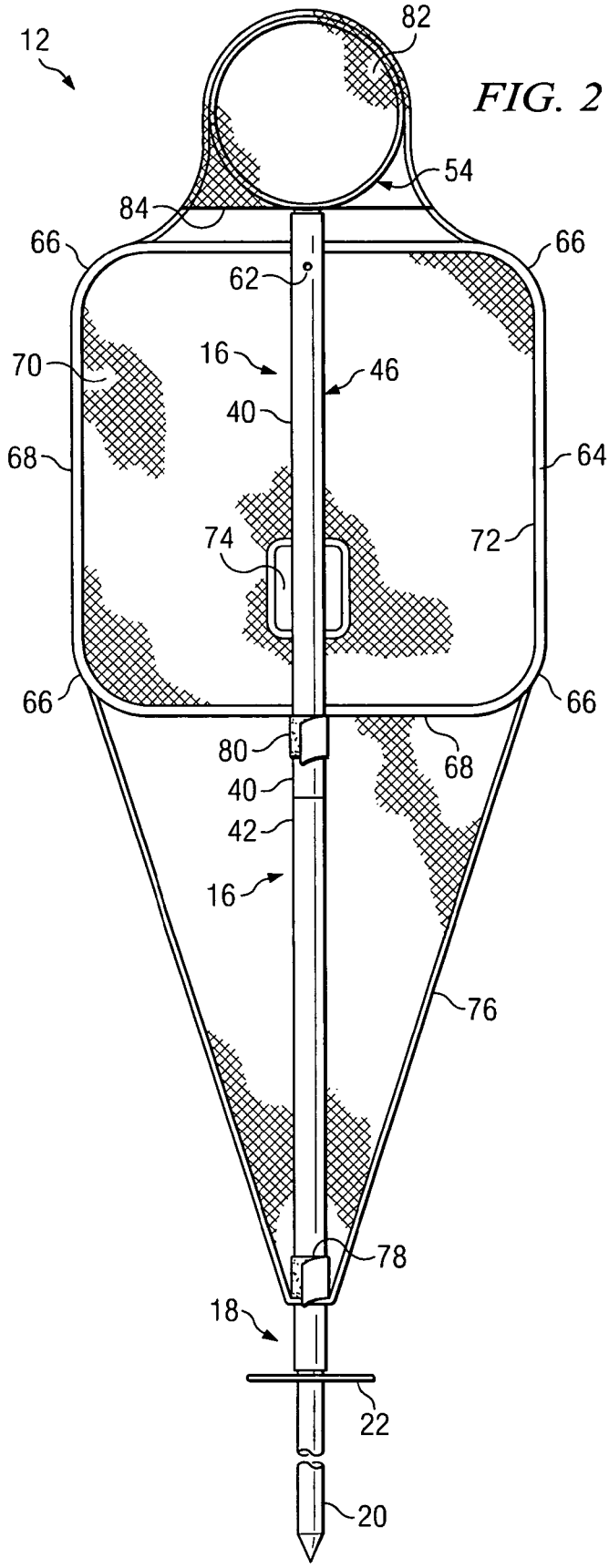
FIG. 2 is a front elevational view of one of the devices of FIG. 1.

Referring to FIG. 2, the obstacle device 12 includes a support member 16, which is held by a base 18 for holding the support member 16 in a generally vertical or upright manner with respect to the playing field.

Figure 3A:
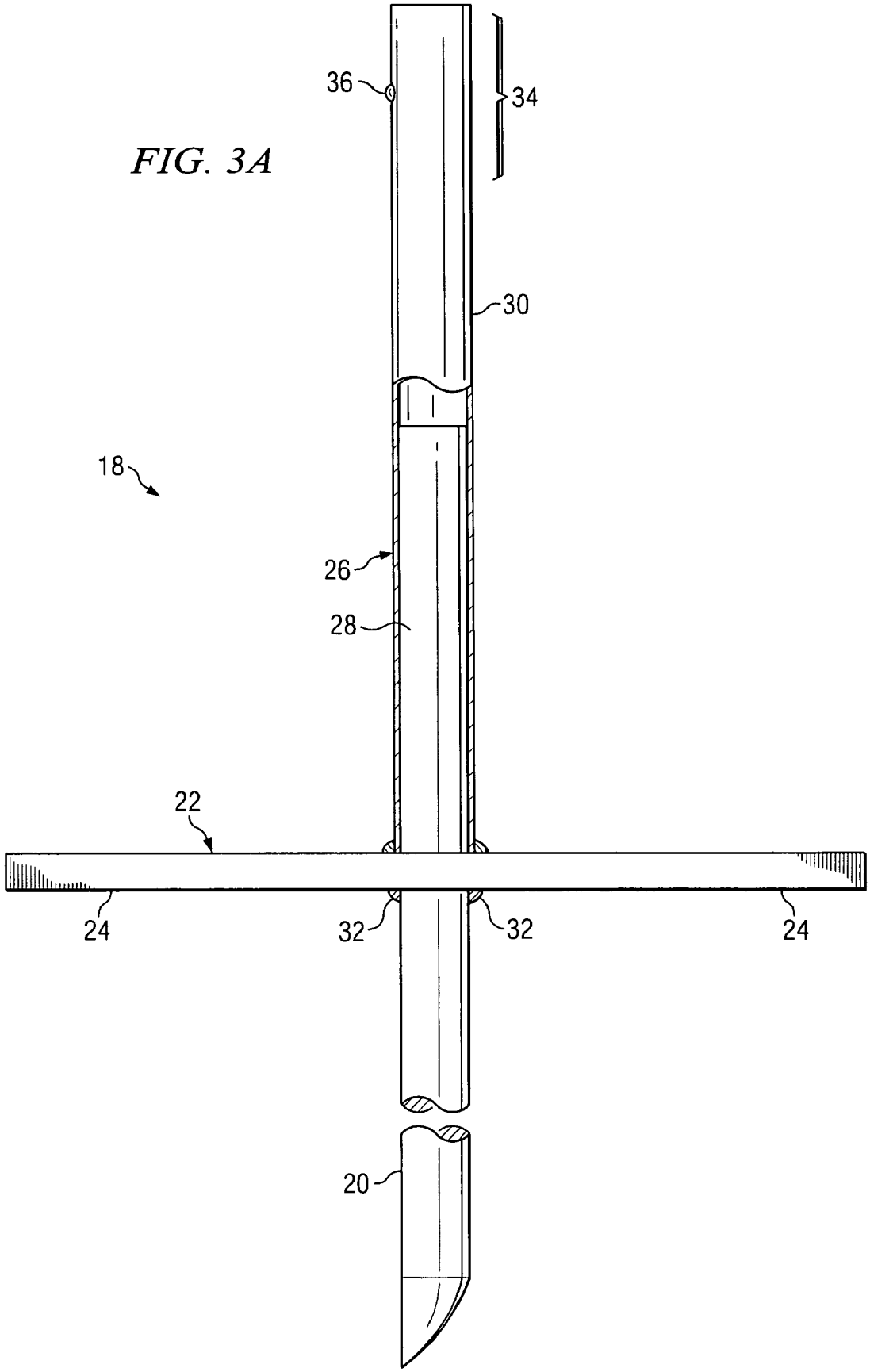
FIG. 3A is a side elevational view of a base of the device of FIG. 2.
Figure 3B:
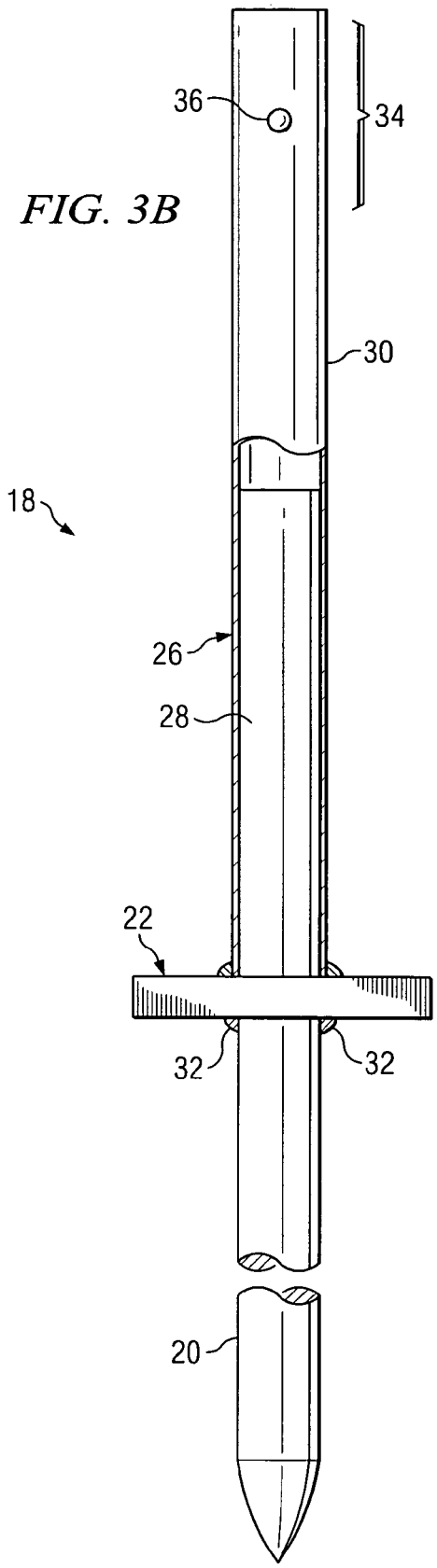
FIG. 3B is a front elevational view of the base of FIG. 3A.

Referring to FIG. 3, the base 18 may include one or more downwardly extending stake members 20. The stake member(s) 20 has a base crossbar or member 22, which may be oriented generally transverse to the stake member 20. As shown in the present embodiment, the cross member 22 may be a generally flat, rectangular member that is oriented in a plane generally perpendicular to the single stake member 20, with the stake member 20 being generally centered on the cross member 22. The cross member 22 may have other configurations, however.

The sides 24 of the cross member or footplate 22 that project outward from the stake member 20 may serve as steps or contact areas wherein a user may place their foot to facilitate insertion of the stake 10 of the base 18 into the ground or other support media. The end of the stake member 20 may also be pointed or tapered to facilitate such insertion. The stake member or members 20 should project a sufficient distance such that the supported obstacle device 12 cannot be readily dislodged or knocked over during normal use. The cross member 22 may also serve as a stop for limiting the staking or insertion of the stake member 20 into the ground and may further stabilize the base 18 once it is inserted.

Extending upward from the cross member 22, opposite the stake member 20, is a neck 26 of the base 18. The neck 26 may be formed into two sections consisting of an inner member 28 and an outer member 30. The inner member 28 may be an upwardly extending continuation of the stake member 20, which may be a single piece, with the crossbar 22 being joined to midsection of the stake. The outer member 30 may be a tubular member that receives the inner member 28, and is joined thereto, such as at the welds 32. The outer member 30 may extend upwardly beyond the inner member 28 to provide a support engagement portion 34. The support engagement portion 34 is provided with a detent 36 or other releasable locking device, which may be in the form of a spring-loaded ball detent that is biased outwardly so that it projects beyond the outer surface of the engagement portion 34.

In an alternate embodiment, the neck 26 of the base 18 may be formed from or incorporate a spring or other elastic member that allows the device 12 to absorb shock, pivot or flex about the base 18, so that the device 12 is not damaged when impacted, such as by a ball or player. The spring or elastic member returns to its original position after being impacted or flexed. This is discussed in Applicants' copending International Application No. PCT/US2004/042939, having an international filing date of Dec. 21, 2004, which is hereby incorporated by reference in its entirety.

Figure 4:
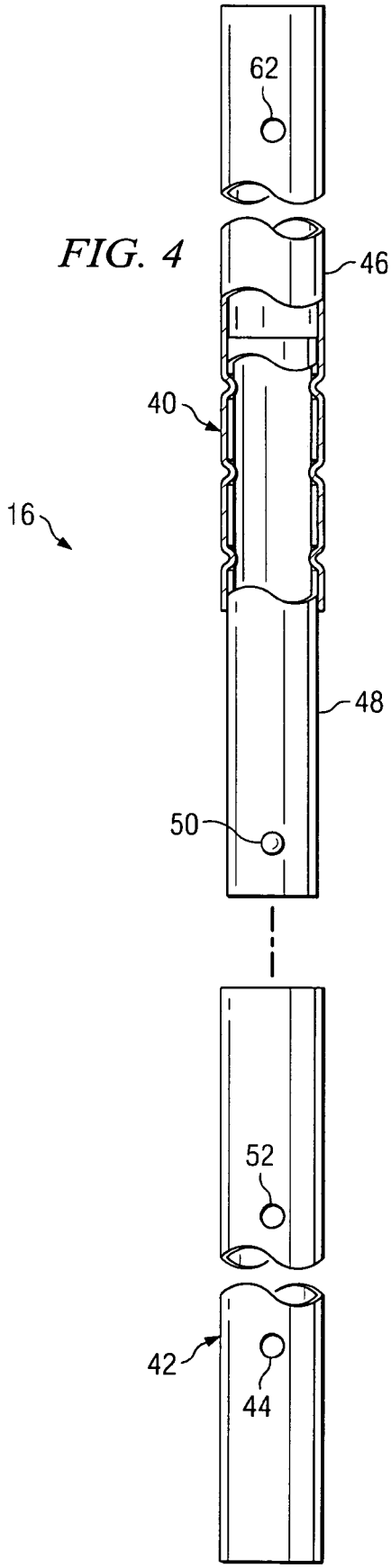
FIG. 4 is a elevational view of a support member of the device of FIG. 2.

The support member 16 may be formed in one or more sections. Referring to FIG. 4, the support member 16 is shown as being formed into upper and lower tubular sections 40, 42, respectively. The lower end of the lower tubular section 42 is sized to fit over the support engagement portion 34 and closely receive the outer member 30 of the base 18. One or more apertures 44 may be provided in the wall of the tubular section 42 to receive the detent 36 and to facilitate locking or coupling the lower section 42 to the base 18.

Several apertures 44 may be provided along the length of the lower section 42 so that it may be positioned at different heights, if desired.

The upper section 40 may be formed as a tubular member 46, with a smaller diameter tubular member or sleeve 48 extending from the lower end of the tubular member 46. The tubular member 46 may have a diameter that is the same or approximate to the tubular section 42. The sleeve 48 is partially received within the lower end of the member 46. A portion of the sleeve 48 extends beyond the tubular member 46. The tubular member 48 may be permanently or non-permanently joined or fastened to the tubular member with fasteners, or through welding, crimping, bonding, and the like. A detent 50 or other releasable locking device, such as a spring-loaded ball detent, is provided with the sleeve 48. The detent is biased outwardly so that it projects beyond the outer surface of the sleeve 48.

The smaller tubular member 48 is sized to be closely received within the upper end of the lower tubular section 42. One or more apertures 52 is provided at the upper end of the lower section 42 to receive the detent 50 and to facilitate locking or coupling of the upper and lower sections 40, 42 together. Several apertures 52 may be provided along the length of the upper end of the lower section 42 so that the tubular sections 40, 42 may be positioned at different relative positions. In the embodiment shown, the aperture 52 and detent 50 are positioned to engage one another when the lower end of the tubular member 46 generally abuts against the upper end of the lower tubular section 42.

The tubular members forming the support member 16 may also be disengagedly coupled together by means of a length or lengths of elastic or bungee cord (not shown) that may pass through the interior of the tubular members and be secured at the end of the outermost members of the support member 16 so that the tubular members remain together when disengaged. The elastic cord may also facilitate retention of the members together when engaged with one another.

The tubular members forming the support member 16 may also be configured for use in a telescoping arrangement, wherein one member or a substantial portion thereof retracts within another for storage. Several tubular members may be used in such a telescoping arrangement.

Referring to FIG. 5, a head piece 54 is shown. The head piece 54 includes a generally circular portion 56, which may be sized to approximate that of the head of a human. The portion 56 may be in the form of a ring with an open center or may be a solid disk-shaped piece of material. Other configurations or shapes, such as oval, rectangular, triangular, polygonal, etc., could be used for the head piece 54, as well.

A neck 58 is joined to and extends from the portion 56. The neck 58 may be formed from a tubular member that is sized to be received within the upper end of the tubular member 46 of the upper section 40 of support member 16. A detent 60 or other releasable locking device, such as a spring-loaded ball detent, may be provided with the neck 58. One or more apertures 62 (FIG. 4) may be provided in the upper end of tubular member 46 for receiving the detent 60 to facilitate locking or coupling of the head piece 54 to the support member 16. The apertures 62 may be provided along the length of the upper end of the tubular member 46 so that the head piece 54 may be positioned at different heights.

Referring to FIG. 2, a frame member 64 is provided. The frame member 64 may be in the form of a resilient, flexible hoop, which is shown in an expanded configuration that generally defines an expanded frame area. The frame member 64 may be of spring steel wire or other material that is capable of being deformed to a collapsed configuration and which may be returned to an expanded configuration without any substantial plastic or permanent deformation. The collapsed configuration defines a collapsed frame area that is less than the expanded frame area. The collapsed frame area may be one-half, one-third, one-fourth or less than that of the expanded frame area. In one embodiment, the frame member 64 may be a continuous hoop member that is collapsed by twisting the hoop member 64 into two or more smaller hoops, which may be positioned adjacent or generally concentrically with one another.

As shown in the present embodiment, the frame member 64 has an expanded configuration that is of a generally square or rectangular shape, and which may have rounded corners 66, which are joined by generally linear side edges 68. The frame member 64 may have other shapes, such as oval, rectangular, triangular, polygonal, etc., for the expanded configuration, as well. Together, the head piece 54 and frame member 64 may form a frame of the device 12 approximating in shape the front profile of a human head and torso.

Optionally, the frame member may be formed from one or more pieces or sections that may be assembled together or disassembled to form the collapsed and expanded configurations.

Covering the frame member 64 is a layer of fabric cover material 70. The fabric material 70 may be attached to the frame 64 in a variety of ways, but may include a seam or sleeve 72 along its perimeter that encases or encloses the frame member 64, with the frame member 64 spreading the fabric when the frame member 64 is in the expanded configuration. The fabric 70 may include a mesh material with numerous small openings to allow the passage of air through the material. A hand opening 74 may also be provided in the fabric material 70 that is sized to allow one's hand to pass through the cover material 70. The opening 74 may generally overlay the support member 16 when the frame member 70 is coupled thereto to facilitate grasping of the support member 16 through the cover 70.

A lower skirt portion 76 of fabric material, which may be the same as that of the cover 70, is also provided. The skirt portion 76 is joined or attached to the lower end of the frame 64 and may connected to the frame cover material 70, generally along the lower side edge 68 of the frame 64. In the embodiment shown, the skirt portion 76 tapers or narrows in width towards its lower end, with the lower end of the skirt portion 76 attaching to the support member 16 near the base 18, when the support member 16 is coupled thereto. This may be accomplished through a releasable attachment device 78, such as a hook and loop fastener or Velcro® that is sewn or attached to the skirt portion 76 and engages or secures around the support member 16.

One or more additional attachment devices 80, such as a hook and loop fastener, may be provided along the length of the skirt portion 76 or fabric frame cover 70 for engagement with the support member 16 to facilitate attachment thereto.

A fabric head piece portion 82, which may be the same or similar to the fabric material as the skirt 76 or cover 70, is also provided. The portion 82 is joined or attached to the upper end of the frame 64 and may connected to the fabric cover 70. The head piece portion 82 may be formed into a pocket having an opening 84 and may be configured for receiving the head piece 54. The pocket portion 82 may also be used for receiving and storing the fabric covered frame member 62 and fabric skirt 76, as is discussed further on.

The device 12 is assembled from its various components as follows. The support member 16 is assembled by connecting the individual sections 40, 42 together. This is accomplished by inserting the sleeve 48 of the upper section 40 into the upper end of lower section 42. The sections 40, 42 may be locked together by aligning the detent 50 with the aperture 52 so that it is received therein.

The support member 16 may then be coupled to the base 18. The base 18 may initially be positioned at a desired area of the playing field on which it is to be used. The stake 20 is inserted into the ground or other support media so that it is securely held. The cross bar 22 may serve as a steps or contact areas for placing one's foot to facilitate insertion of the stake 20. The lower end of the tubular section 42 of the support member 16 is then positioned over the outer tubular member 30 of the base 18 with the engagement portion 34 inserting therein. By aligning the detent 36 of the member 30 with the aperture 44 so that it is received therein, the base 18 and support member 16 may be locked together.

The collapsed frame member 64, with the fabric cover 70 and skirt 76 may initially be stored within the pocket portion 82. Optionally, the head piece portion 54 may also be initially stored within the pocket 82. These are removed from the pocket portion 82.

The head piece 54 may be coupled to the support member 16 by inserting the neck 58 into the upper end of tubular section 40. The detent 60 of the neck 58 may be received within the aperture 62 to lock the head piece 54 to the support member.

The covered frame member 64 is expanded from its collapsed configuration, such as by untwisting the smaller hoops or otherwise, to its fully expanded configuration. The pocket portion 82 is positioned over the head piece 54, which is secured to the support member 16, so that the frame member 64 and skirt portion 76 are essentially supported by the support member 16 by means of the pocket 82. The fasteners or attachment devices 78, 80 are also used to engage the support member and secure the frame member 64 and skirt 76 to the support 16.

After use, the device 12 may be quickly and easily disassembled and collapsed to facilitate transporting and storage. To disassemble the device 12, attachment devices 78, 80 are disengaged from the support member 16 and the pocket portion 82 with attached frame member 64 and skirt 76 are lifted off the head piece 54. The covered frame member 64 may then be collapsed, such as by twisting the member into smaller overlapping or concentric loops. The collapsed frame member 64 and skirt 76 may then be inserted into the pocket portion 82 and stored therein.

The head piece 54 may be removed by disengaging the detent 60 from the aperture 62 and sliding it off the support member 16. Likewise, the support member 16 may be removed from the base 18 by disengaging the detent 36 from the aperture 44 and sliding it off the engagement portion 34. The support member 16 may also be disassembled by disengaging the detent 50 from the aperture 52 and sliding the sleeve 48 out of the tubular member 42.

A carrying case or other container (not shown) may be provided with the device 12 to conveniently hold or store the various components or a plurality of the devices.

During use, the device 12 is positioned at the desired area and may serve as a blocking wall or obstacle that approximates the front profile of a human head and torso. This frees other players from serving as an obstacle or blocking wall so that they can participate in more beneficial activities. Several of the devices 12 may be utilized and be positioned side by side or in other configurations, as may be desired.

The material of the frame member 64 may be resiliently deformable so that when the frame member 64 is impacted, such as by a ball or contact with a player, the frame member 64 bends, flexes, pivots or otherwise deforms. The frame member 64 may also be securely but loosely coupled to the support member 16, such as through the attachment devices 78, 80 and pocket 82, so that it is allowed to rotate or pivot at the attachments somewhat relative to the support 16. This facilitates prevention of injury to the player or damage to the device 12. Additionally, this also facilitates the anchoring and supporting of the device 12 in an upright position, since any impacting forces transmitted to the support 16 and base 18 are lessened. In this way, only a single staking member 20 may be used while still readily holding the device in an upright manner.

Furthermore, the crossbar 22 facilitates maintaining the device 12 in an upright position. The cross member 22 may be oriented so that its length is generally perpendicular to the width of the frame member 64. This further facilitates stabilization of the device from forward and rearward directed forces, which may be more commonly encountered.

The device is lightweight, easy to assemble and disassemble, and can be easily transported or stored without taking up large amounts of space. The opening 74 formed in the cover 70 allows the user to grasp the support member 16 at its approximate midsection through the cover so that the device 12 may be grasped from either side and carried easily from place to place while the device is in the assembled configuration.

Figure 6:
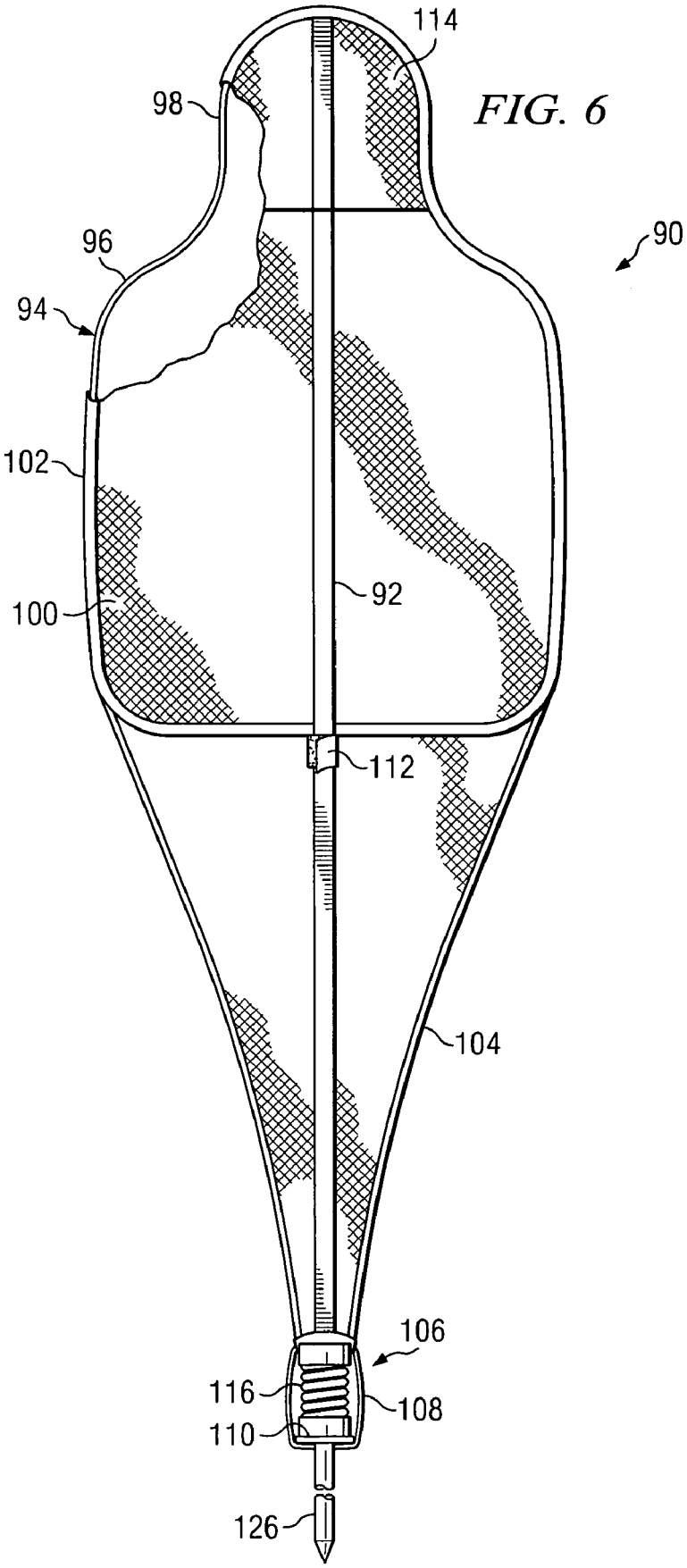
FIG. 6 is a front elevational view of an obstacle device constructed in accordance with an alternate embodiment of the invention.

Referring to FIG. 6, another obstacle device 90 is shown. The obstacle device 90 is similar to the obstacle device 12 in many respects. The obstacle device 90 may include an elongate support member 92, which may be formed in one or more sections and may be similar to the support member 16 of the device 12, previously discussed.

The device 90 includes a frame member 94 that is in the form of a resilient, flexible hoop, which is shown in an expanded configuration that generally defines an expanded frame area. The frame member 94 may be similar to the frame member 64, previously described, but is shaped to incorporate both a torso portion 96 and head portion 98, as shown, thus eliminating the need for a separate headpiece. The frame member 94 may be a collapsible continuous hoop that may be collapsed by twisting the hoop into two or more smaller hoops, which may be positioned adjacent or generally concentrically with one another.

A covering material 100 may be attached to the frame member 94, such as by a seam or sleeve 102 along its perimeter that encases or encloses the frame member 94, with the frame member 94 spreading the material 100 when the frame member 94 is in the expanded configuration.

A lower skirt portion 104 is also provided. The skirt portion 104 is joined or attached to the lower end of the frame member 94 and may be joined to the frame cover material 100 or be formed from portion thereof. In the embodiment shown, the skirt portion 104 tapers or narrows in width towards its lower end, with the lower end of the skirt portion 104 securing to a base 106 of the device 90 by means of a loop 108 of elastic material, which is positioned around a cross member or footplate 110 of the base 106.

One or more additional attachment devices 112, such as a hook and loop fastener, may also be provided along the length of the skirt portion 104 or fabric frame cover 100 for engagement with the support member 92 to facilitate attachment thereto.

A pocket 114, which may be formed from a layer of the same or similar material to that of the skirt 104 or cover 100, overlaying the head portion 96, is also provided. The pocket 114 receives the upper end of the support member 92 and facilitates attachment of the frame member 94 to the support 92. It may also serve as storage area for the smaller hoops of the collapsed frame member 94. Optionally, the pocket 114 may be configured as a narrow sleeve or pocket that closely receives the upper end of the support member 92. Other attachment means may also be used for attaching the head portion 98 to the upper end of the support member 92.

Figure 7:
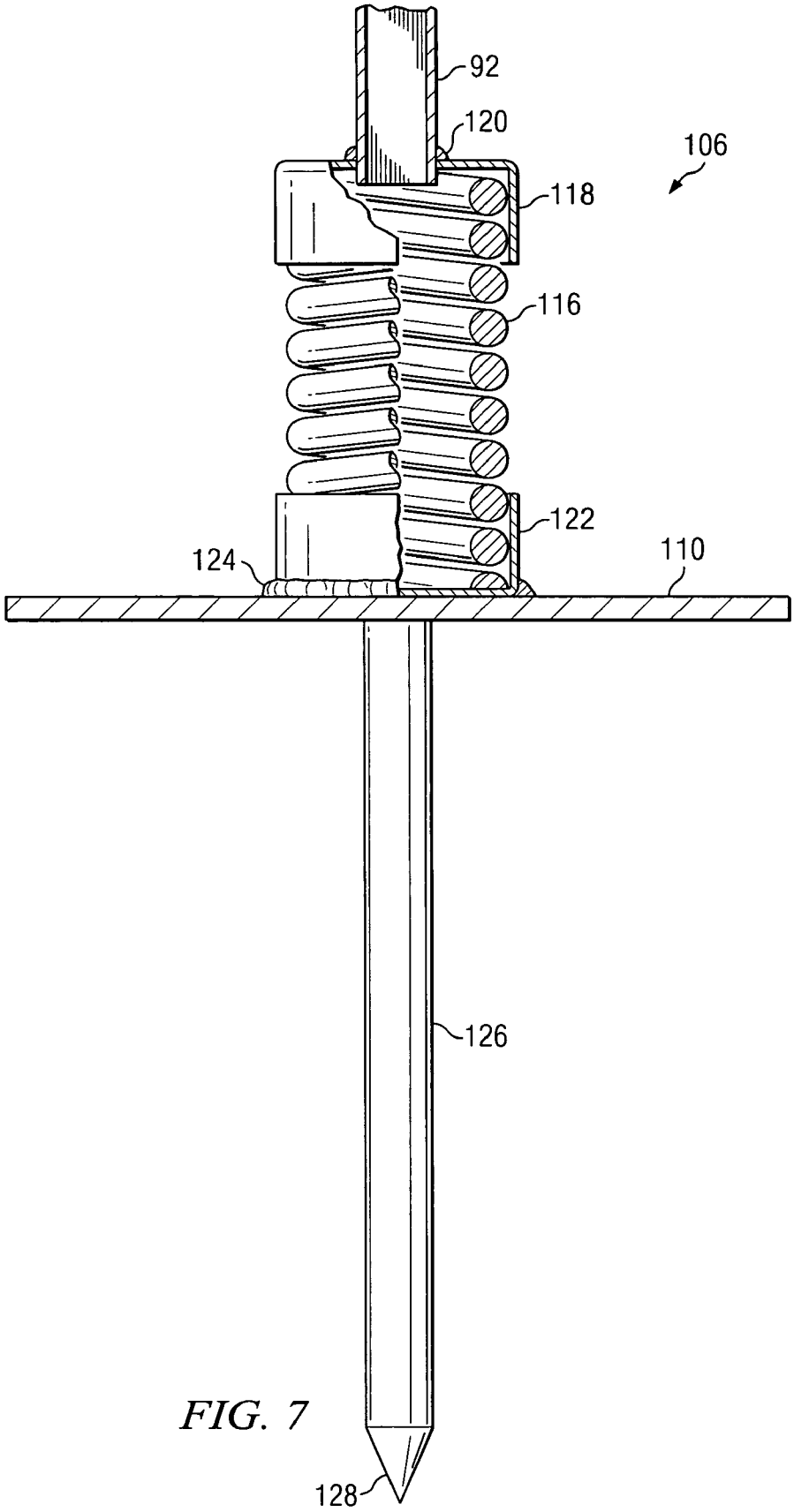
FIG. 7 is a side elevational view of the base of the device of FIG. 6, shown partially cross sectioned.

Referring to FIG. 7, a more detailed view of the base 106 is shown. The base 106 employs an elastic member for allowing the support member 92, which carries the frame member 94, to flex or pivot relative to the base 106. In the embodiment shown, the elastic member is in the form of a coiled steel spring 116, although other elastic elements, both metal and non-metal, may also be employed. The spring 116 may be joined to the lower end of the support member 92 by means of a cap or cup element 118, which receives and couples to the upper end portion of the spring 116. The cap 116 may be secured to the lower end of the support member 92 by welds 120 or other means.

Similarly, the lower end of the spring 116 may be coupled to the upper surface of the cross member or footplate 110 by means of lower cap or cup member 122, such as by welds 124 or other means.

The base 106 may include a staking member 126, which may be provided with a tapered or pointed end 128 to facilitate insertion into a support medium. The stake member 128, coiled spring 116 and support member 92 may be oriented so that they are generally coaxial.

The device 90 is used in a similar manner as the device 12, previously discussed. The device 90, however, eliminates the need for a separate headpiece attachment.

In addition to the material of the frame member 94 being resiliently deformable or providing pivotal or rotating motion relative to the support 92, the support member 92 may also flex or pivot relative to the base 106 by means of the spring 116 or other elastic element of the base 106. This further facilitates prevention of injury to players or damage to the device 92. Additionally, this also facilitates anchoring and supporting of the device 92 in an upright position, since the support 92 will tend to flex or pivot relative to the base 110, thus resisting any tendency of the base 106 to become dislodged from the support media in which it is positioned.

The obstacle device of the invention, such as the devices 12 and 92, can be provided as part of a kit. In such instances, two or more of the devices may be provided together. A carrying case or other container (not shown) may be provided with the devices to conveniently hold or store the various devices and their components.

Figure 8:
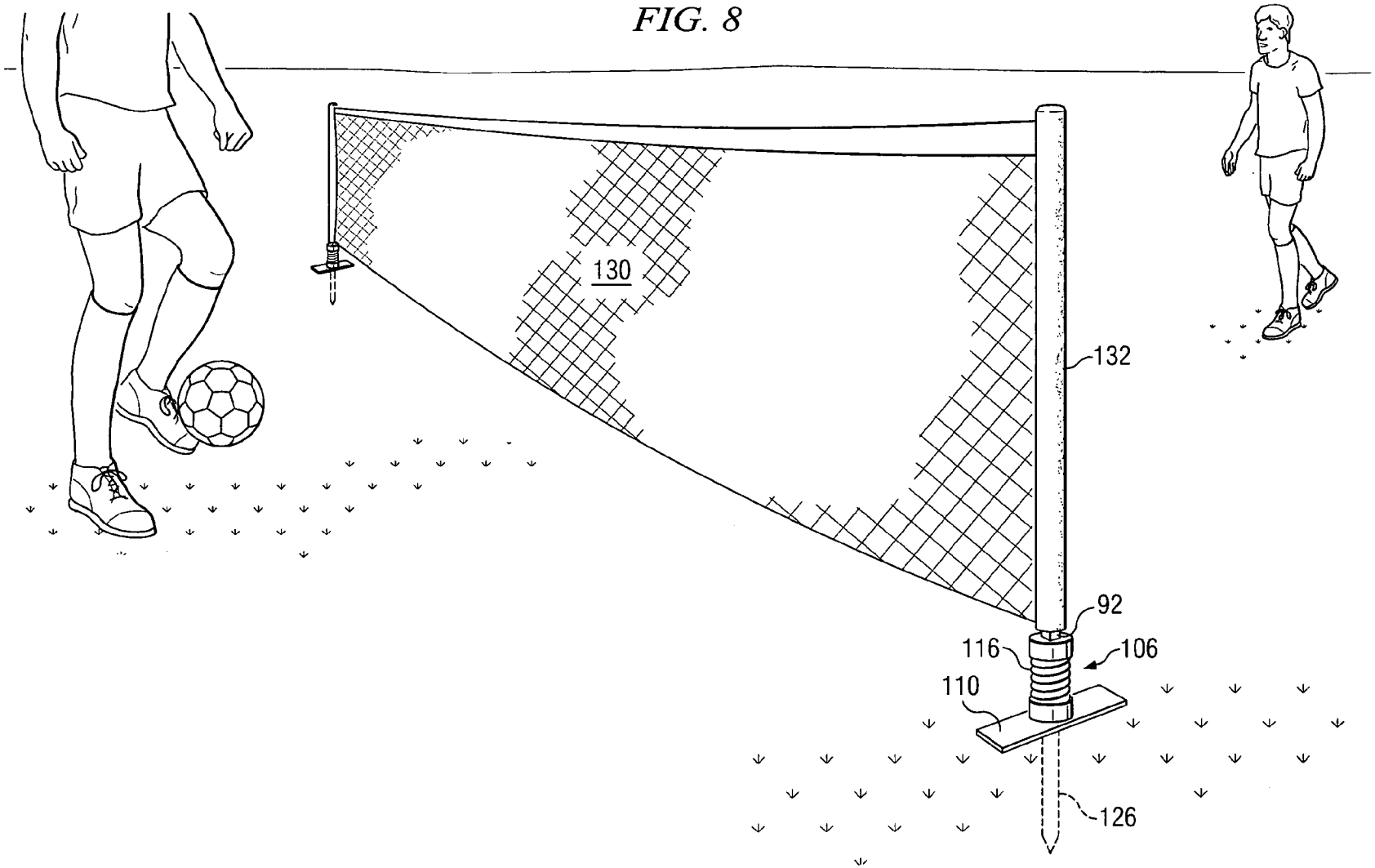
FIG. 8 is a perspective view of a net extended between two support members constructed in accordance with another embodiment of the invention.

Additionally, other equipment may be provided as part of the kit. Referring to FIG. 8, one or more nets 130, such as a soccer or volley net, may be provided with the kit. The net 130 may be of various sizes and configurations. The net 130 may be provided with attachment elements 132, such as sleeves, loops or straps, at each end for attaching to a support member, such as the support members 16 and 92, of one of the obstacle devices, previously described. Optionally, the net may be provided with its own designated support members, which may be configured the same or similar to those as already described herein. Depending upon the height of the net, for support members employing two or more sections, less than all the sections may be used to support the net 130, if of sufficient height. The support members may then be spaced apart and anchored into the ground or other support media, stretching out the net 130, as shown. Optionally, one or more balls or other playing devices or equipment may be included with the kit. In this way, the kit provides a means for setting up a playing field with a net or nets to form goals, as well as providing obstacles.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

We claim:

1. An obstacle device for use on a playing field, the device comprising:

a base;

a frame approximating in shape the front profile of a human head and torso coupled to the base, the frame including a resiliently collapsible frame member that has an expanded configuration that defines a generally planar expanded frame area and a collapsed configuration that defines a collapsed frame area that is less than the expanded frame area; and a covering material attached to the frame so that the covering material is spread by the frame when the frame member is in the expanded configuration.

2. The obstacle device of claim 1, wherein:

the frame member includes a resilient, flexible hoop.

3. The device of claim 2, wherein:

the flexible hoop of the frame member approximates in shape the front profile of a human head and torso when in the expanded configuration.

4. The device of claim 1, further comprising:

the base includes a stake member for staking into the ground or support media of the playing field, the frame coupling to the base so that the frame is held by the base in a generally upright manner.

5. The device of claim 1, wherein:

the frame includes an elongate support member, with the frame member coupling to the support member.

6. The device of claim 1, wherein;

the frame is pivotable relative to the base.

7. The device of claim 1, wherein:

the base includes an elastic member that allows the frame to pivot relative to the base.

8. The device of claim 1, wherein:

the base includes a footplate.

9. The device of claim 1, wherein:

the covering material is a fabric material.

10. The device of claim 1, wherein:

the frame member is resiliently deformable upon being impacted.

11. An obstacle device for use on a playing field comprising:

a base;

an elongate support member coupled to the base;

a frame approximate in shape the front profile of a human head and torso, the frame having a frame member in the form of a resilient, flexible hoop removably coupled to the support member, the frame member having an expanded configuration that defines an expanded frame area of the frame, the frame member being resiliently deformable to a collapsed configuration that defines a collapsed frame area that is less than the expanded frame area; and a covering material attached to the frame so that the fabric material is spread by the frame when the frame member is in the expanded configuration.

12. The device of claim 11, wherein:

the support member is formed into at least two sections that releasably engage one another.

13. The device of claim 11, further comprising:

the base includes a stake member for staking into the ground or support media of the playing field, the support member coupling to the base so that the support member is held by the base in a generally upright manner when the base is staked into the ground or support media.

14. The device of claim 11, wherein;

the frame is pivotable relative to the base.

15. The device of claim 11, wherein:

the base includes an elastic member that allows the frame to pivot relative to the base.

16. The device of claim 11, wherein:

the flexible hoop of the frame member approximates in shape the front profile of a human head and torso when in the expanded configuration.

17. The device of claim 11, wherein:

the covering material is a fabric material.

18. The device of claim 11, wherein:

the frame member is resiliently deformable upon being impacted.

19. An obstacle device for use on a playing field, the device comprising:

a base;

a non-inflatable frame approximating in shape the front profile of a human head and torso coupled to the base, the frame including a resiliently collapsible frame member that has an expanded configuration that defines an expanded frame area and a collapsed configuration that defines a collapsed frame area that is less than the expanded frame area; and a covering material attached to the flame so that the covering material is spread by the frame when the frame member is in the expanded configuration.

* * * * *